US009338557B2

(12) United States Patent
Nakamura

(10) Patent No.: US 9,338,557 B2
(45) Date of Patent: May 10, 2016

(54) ACOUSTIC GENERATOR, ACOUSTIC GENERATION DEVICE, AND ELECTRONIC DEVICE

(71) Applicant: KYOCERA Corporation, Kyoto-shi, Kyoto (JP)

(72) Inventor: Shigenobu Nakamura, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 14/646,437

(22) PCT Filed: Aug. 23, 2013

(86) PCT No.: PCT/JP2013/072584
§ 371 (c)(1),
(2) Date: May 21, 2015

(87) PCT Pub. No.: WO2014/103424
PCT Pub. Date: Jul. 3, 2014

(65) Prior Publication Data

US 2015/0296303 A1 Oct. 15, 2015

(30) Foreign Application Priority Data

Dec. 25, 2012 (JP) ..... 2012-281286

(51) Int. Cl.
*H04R 17/00* (2006.01)
*H04R 7/18* (2006.01)
(Continued)

(52) U.S. Cl.
CPC ..... *H04R 17/00* (2013.01); *H04R 1/02* (2013.01); *H04R 3/002* (2013.01); *H04R 7/18* (2013.01);
(Continued)

(58) Field of Classification Search
CPC ..... H04R 2440/00–2440/07; H04R 1/08; H04R 9/08; H04R 11/04; H04R 17/02; H04R 21/02; H04R 2217/00–2217/03; H04R 9/00; H04R 7/04
USPC ..... 381/152, 176, 190, 396, 398, 431
See application file for complete search history.

(56) References Cited

U.S. PATENT DOCUMENTS 1,919,632 A * 7/1933 Haigis ..... H04R 7/16 381/152
3,614,335 A * 10/1971 Dymoke-Bradshaw . H04R 7/18 381/354

(Continued)

FOREIGN PATENT DOCUMENTS

JP 2004-023436 A 1/2004
JP 4975197 B2 4/2012
JP 2012-110018 A 6/2012

OTHER PUBLICATIONS

Korean Notice of Rejection with English concise explanation, Korean Patent Application No. 10-2013-7030728, Oct. 7, 2014, 4 pgs.

(Continued)

*Primary Examiner* — Suhan Ni
(74) *Attorney, Agent, or Firm* — Volpe and Koenig, P.C.

(57) ABSTRACT

An acoustic generator according to an embodiment at least includes an exciter, a vibrating plate, and a frame body. The exciter is caused to vibrate by an electrical signal. The exciter is mounted on the vibrating plate, and the vibrating plate is caused to vibrate together with the exciter by the vibration of the exciter. The frame body is provided on the outer peripheral portion of the vibrating plate. The frame body includes two frame members having different thicknesses or widths, and the two frame members nip the vibrating plate to support the vibrating plate.

10 Claims, 5 Drawing Sheets

(51) Int. Cl.

| | |
|---|---|
| ***H04R 1/02*** | (2006.01) |
| ***H04R 3/00*** | (2006.01) |
| *H04R 1/28* | (2006.01) |
| *H04R 19/00* | (2006.01) |

(52) U.S. Cl.
CPC ..... *H04R 17/005* (2013.01); *H04R 1/2873* (2013.01); *H04R 19/005* (2013.01); *H04R 2201/003* (2013.01); *H04R 2499/11* (2013.01)

(56) References Cited

U.S. PATENT DOCUMENTS 3,697,790 A * 10/1972 Flint ..... H04R 17/00 381/190
4,122,314 A * 10/1978 Matsuda ..... H04R 7/02 381/398
5,432,758 A * 7/1995 Sone ..... H04R 9/00 381/398
7,181,040 B2 * 2/2007 Ohta ..... H04R 1/02 381/396
7,583,812 B2 * 9/2009 Honda ..... H04R 1/021 381/152
2013/0094681 A1 4/2013 Fukuoka et al.
2014/0314255 A1 10/2014 Fukuoka et al.

OTHER PUBLICATIONS

International Search Report, PCT/JP2013/072584, Nov. 12, 2013, 1 pg.
Taiwanese Office Action with English concise explanation, Taiwan Patent Application No. 102143535, Dec. 31, 2015, 5 pgs.

* cited by examiner

ACOUSTIC GENERATOR, ACOUSTIC GENERATION DEVICE, AND ELECTRONIC DEVICE

CROSS-REFERENCE TO RELATED APPLICATIONS

This application is national stage application of International Application No. PCT/JP2013/072584, filed on Aug. 23, 2013, which designates the United States, incorporated herein by reference, and which claims the benefit of priority from Japanese Patent Application No. 2012-281286, filed on Dec. 25, 2012, the entire contents of which are incorporated herein by reference.

FIELD

The embodiments disclosed herein relate to an acoustic generator, an acoustic generation device, and an electronic device.

BACKGROUND

Acoustic generators, typified by piezoelectric speakers, are conventionally known to be used as small and thin speakers. Such acoustic generators can be used as speakers built in electronic devices including mobile phones and flat televisions.

An acoustic generator includes, for example, a rectangular frame body, a film stretched across the frame body, and a piezoelectric vibrating element provided on the film (see Patent Literature 1). This is configured such that the film having the outer edge portion supported by the frame body is excited, and the resonance of the film is used to generate sound.

CITATION LIST

Patent Literature

Patent Literature 1: Japanese Patent Application Laid-open No. 2004-23436

SUMMARY

Solution to Problem

An acoustic generator according to an aspect of the embodiments at least includes an exciter, a vibrating plate, and a frame body. The exciter is caused to vibrate by an electrical signal. The exciter is mounted on the vibrating plate, and the vibrating plate is caused to vibrate together with the exciter by the vibration of the exciter. The frame body is provided on the outer peripheral portion of the vibrating plate. The frame body includes two frame members having different thicknesses or widths, and the two frame members nip the vibrating plate to support the vibrating plate.

An acoustic generation device according to an aspect of the embodiments includes the acoustic generator and a housing that accommodates the acoustic generator.

An electronic device according to an aspect of the embodiments includes the acoustic generator, an electronic circuit that is connected to the acoustic generator, and a case that accommodates the electronic circuit and the acoustic generator. The electronic device has a function of producing sound from the acoustic generator.

DESCRIPTION OF EMBODIMENTS

Embodiments of an acoustic generator, an acoustic generation device, and an electronic device that are disclosed by the present application will now be explained in detail with reference to the appended drawings. The embodiments described hereunder are not intended to limit the scope of the present invention in any way.

Figure 1A:
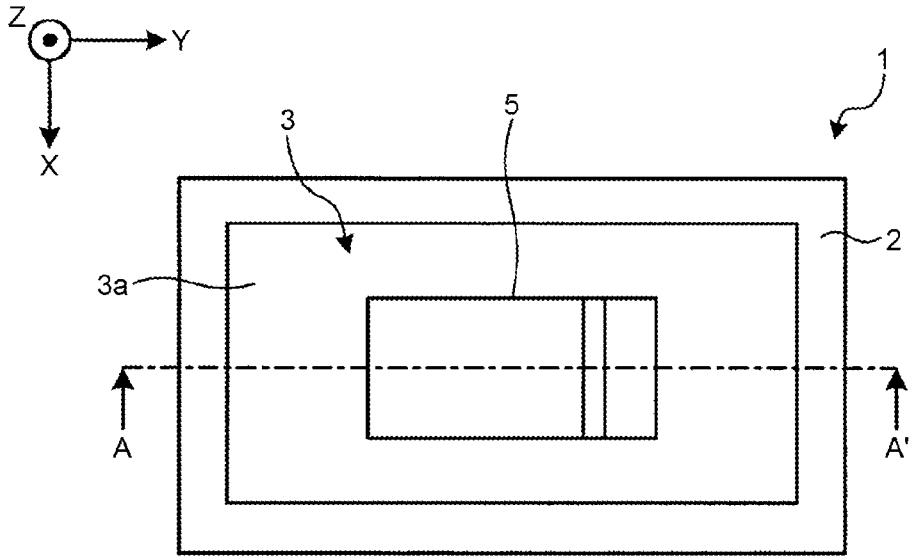
FIG. 1A is a schematic plan view illustrating a configuration of an acoustic generator according to an embodiment.

First of all, a configuration of an acoustic generator 1 according to an embodiment will be described. FIG. 1A is a schematic plan view illustrating a configuration of the acoustic generator 1 according to the embodiment, and FIG. 1B is a cross sectional view along the line A-A' in FIG. 1A.

Figure 1B:
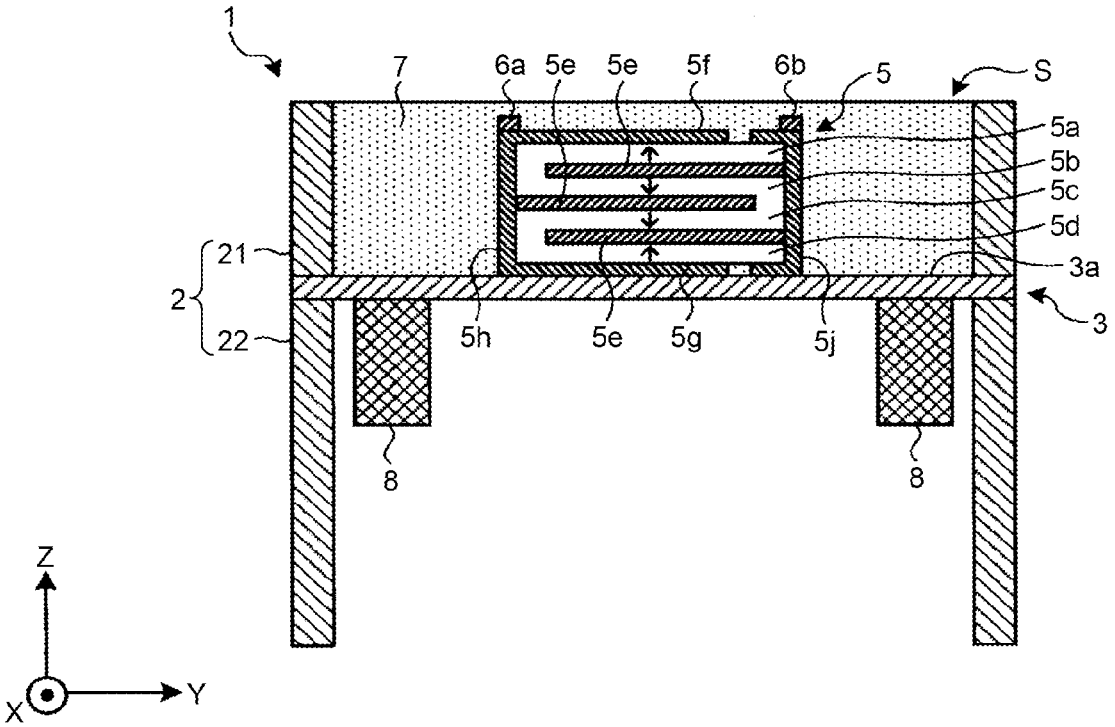
FIG. 1B is a cross sectional view along the line A-A' in FIG. 1A.

To facilitate understanding of the explanation, included in FIGS. 1A and 1B is a three-dimensional Cartesian coordinate system having a Z axis the positive direction of which extends perpendicularly upwardly and the negative direction of which extends perpendicularly downwardly. This Cartesian coordinate system is included in some of the drawings referred to in the following explanation. A resin material 7 is omitted in FIG. 1A.

Also to facilitate understanding of the explanation, illustrated in FIG. 1B is the acoustic generator 1 the thickness direction of which (Z-axial direction) is exaggeratingly enlarged.

As illustrated in FIG. 1A, the acoustic generator 1 includes a frame body 2, a vibrating plate 3, and a piezoelectric element 5 serving as an exciter. Although the example in the following description includes a single piezoelectric element 5 as illustrated in FIG. 1A, the number of piezoelectric elements 5 is not limited.

The frame body 2 includes an upper frame member 21 and a lower frame member 22 as illustrated in FIG. 1B and nips the outer peripheral portion (the peripheral edge portion) of the vibrating plate 3 to support the vibrating plate 3. The vibrating plate 3 has a plate-like or film-like shape and is fixed such that the outer peripheral portion thereof is nipped in the frame body 2. That is, the vibrating plate 3 is supported flatly by the frame body 2 in such a manner as to be stretched within the frame body 2.

The inner portion of the vibrating plate 3, being inner with respect to the frame body 2, and that is not nipped by the frame body 2 and is capable of freely vibrating serves as a vibrating body 3*a*. The vibrating body 3*a* is a substantially rectangular portion that is on the inner side of the frame body 2.

The vibrating plate 3 may be made of various types of materials, such as a resin or a metal. For example, the vibrating plate 3 may be a film made of a resin such as polyethylene or polyimide and having a thickness of 10 to 200 micrometers.

The thickness, material, and others of the upper frame member 21 and the lower frame member 22 that constitute the frame body 2 are not particularly limited. The frame body 2 may be formed of a variety of materials including metals and resins. For example, stainless steel with a thickness of 100 to 5000 micrometers may be preferably used as the upper frame member 21 or the lower frame member 22 that constitutes the frame body 2, for the reasons of excellent mechanical strength and high corrosion resistance.

While FIG. 1A illustrates the frame body 2 of which the inner region has a substantially rectangular shape, the inner region of the frame body 2 may have a polygonal shape such as a parallelogram shape, a trapezoidal shape, and an n-sided regular polygonal shape. Explained in the embodiment is an example in which the frame body 2 has a substantially rectangular shape, as illustrated in FIG. 1A.

The piezoelectric element 5 is an exciter that is provided by being bonded to the surface of the vibrating plate 3 (vibrating body 3*a*), for example, and excites the vibrating body 3*a* by receiving application of a voltage and vibrating.

As illustrated in FIG. 1B, the piezoelectric element 5 includes piezoelectric layers 5*a*, 5*b*, 5*c*, and 5*d*, a laminate body, surface electrode layers 5*f* and 5*g*, and external electrodes 5*h* and 5*j*. The piezoelectric layers 5*a*, 5*b*, 5*c*, and 5*d* are formed by four-layered ceramics. The laminate body is formed by alternately laminating three internal electrode layers 5*e*. The surface electrode layers 5*f* and 5*g* are formed on the upper surface and the lower surface, respectively, of the laminate body. The external electrodes 5*h* and 5*j* are formed on the side surfaces to which the internal electrode layers 5*e* are exposed.

The piezoelectric element 5 has a plate-like shape the principal surfaces of which at the upper and the lower have a polygonal shape such as a rectangle or a square. The piezoelectric layers 5*a*, 5*b*, 5*c*, and 5*d* are polarized as indicated by the arrows in FIG. 1B. In other words, the piezoelectric layers 5*a*, 5*b*, 5*c*, and 5*d* are polarized in opposite directions on one side and the other side in the thickness direction (Z-axial direction in FIG. 1B), with respect to the direction of the electric field applied at a particular moment.

When a voltage is applied to the piezoelectric element 5 via lead terminals 6*a* and 6*b*, the piezoelectric element 5 is deformed such that the piezoelectric layers 5*c* and 5*d* at the side attached to the vibrating body 3*a* contract whereas the piezoelectric layers 5*a* and 5*b* at the upper surface side of the piezoelectric element 5 expand at one moment, for example. By applying an alternating-current signal to the piezoelectric element 5, therefore, the piezoelectric element 5 is caused to bend and vibrate, thereby causing the vibrating body 3*a* to bend and vibrate.

A principal surface of the piezoelectric element 5 is bonded to a principal surface of the vibrating body 3*a* using an adhesive such as epoxy-based resin.

As a material constituting the piezoelectric layers 5*a*, 5*b*, 5*c*, and 5*d*, conventionally used piezoelectric ceramics such as lead zirconate titanate, and Bi layered compound and tungsten bronze structure compound, such as other non-lead piezoelectric substance materials, can be used.

Various types of metallic materials may be used for the internal electrode layers 5*e*. When a material with a metallic component consisting of silver and palladium, and a ceramic component used in the piezoelectric layers 5*a*, 5*b*, 5*c*, and 5*d*, for example, are included, a stress caused by the difference in the thermal expansions in the piezoelectric layers 5*a*, 5*b*, 5*c*, and 5*d* and the internal electrode layers 5*e* can be reduced, so that the piezoelectric element 5 with no defective lamination can be achieved.

The lead terminals 6*a* and 6*b* may be made of various types of metallic materials. When the lead terminals 6*a* and 6*b* are provided using flexible wiring in which a foil made of a metal such as copper or aluminum is interposed between resin films, for example, a low-profile piezoelectric element 5 can be provided.

As illustrated in FIG. 1B, the acoustic generator 1 further includes the resin material 7. The resin material 7 is disposed in such a manner as to cover the piezoelectric element 5 and the surface of the vibrating plate 3 in a space S (hereinafter referred to as "internal space S") formed with that surface of the vibrating body 3*a* on which the piezoelectric element 5 is provided and the inner peripheral surface of the upper frame member 21, and is integrated with the vibrating plate 3 (vibrating body 3*a*) and the piezoelectric element 5.

For the resin material 7, a material such as an acrylic-based resin may be used, and the resin material 7 is preferably formed in such a manner that a Young's modulus within a range from 1 MPa to 1 GPa is achieved. By embedding the piezoelectric element 5 in the resin material 7, an appropriate level of damper effect can be achieved, so that the resonance can be suppressed and the peaks and the dips in the sound pressure frequency characteristics can be reduced.

Although the difference between peaks and dips in sound pressure frequency characteristics is reduced by the above-mentioned resin material 7, a damper 8 is further disposed in the present embodiment so that the damper 8 gives a mechanical vibration loss to the vibrating body 3*a*, thereby further reducing the difference between peaks and dips.

The damper 8 is mounted on the surface opposite to that surface of the vibrating plate 3 (vibrating body 3*a*) on which the piezoelectric element 5 is provided, whereby the damper 8 is integrated with the vibrating plate 3 (vibrating body 3*a*), the piezoelectric element 5, and the resin material 7.

Illustrated in FIG. 1B is an example in which the piezoelectric element 5 is a laminated bimorph piezoelectric element, but the piezoelectric element 5 is not limited thereto. For example, the piezoelectric element 5 may be a unimorph piezoelectric element that is a deformable piezoelectric element bonded to the vibrating body 3*a*.

As described above, the frame body 2 includes two frame members, namely, the upper frame member 21 and the lower frame member 22. In the acoustic generator 1 according to the present embodiment, these upper frame member 21 and lower frame member 22 are made of the same material, and the thickness of the upper frame member 21 is different from the thickness of the lower frame member 22. Specifically, the frame body 2 according to the present embodiment includes the upper frame member 21 and the lower frame member 22 thicker than the upper frame member 21, as illustrated in FIG. 1B. The "thickness of the frame member" here refers to the thickness vertical (that is, the Z-axial direction) to the principal surface of the vibrating body 3*a*.

The two frame members 21 and 22 have different thicknesses as described above, and the resonance frequencies of the frame members 21 and 22 are shifted from each other accordingly. The oscillatory wave propagating from the vibrating body 3*a* to the frame body 2 is therefore reflected at different frequencies by the two frame members 21 and 22 with different resonance frequencies.

As a result, the vibration of a composite vibrating body including the vibrating body 3*a*, the piezoelectric element 5, the resin material 7, and the damper 8 that integrally vibrate is disturbed at different frequencies by the reflected waves from the frame members 21 and 22, so that the difference between resonance peaks and dips in sound pressure frequency characteristics is suppressed, and the frequency characteristics can be flattened. Improvement in sound quality therefore can be achieved because of the flattened sound pressure.

In order to measure the respective resonance frequencies of the frame members, first of all, the frame members are removed from the vibrating body, and, for example, using a spectrum analyzer as a measuring device, a sound signal is transmitted through the frame members with frequencies changing from low frequencies to high frequencies. A strong signal of the spectrum analyzer is observed when the frame member resonates at the resonance frequency. The resonance frequency thus can be measured.

When the upper frame member 21 and the lower frame member 22 have different thicknesses, although the effects can be achieved as long as the thicknesses are different, it is more effective when the thickness of the thicker frame member is set, for example, 1.5 to 10 times larger than the thickness of the thinner frame member.

In the acoustic generator 1 according to the present embodiment, the piezoelectric element 5 is mounted on that surface of the vibrating plate 3 (vibrating body 3*a*) on which the upper frame member 21 of the two frame members 21 and 22 is disposed. Herein, the upper frame member 21 is thinner than the lower frame member 22.

Of the two frame members 21 and 22, the thinner upper frame member 21 is more deformable by stress. That is, the upper frame member 21 vibrates more easily than the lower frame member 22. By providing the piezoelectric element 5 on that side on which the thinner upper frame member 21 is disposed, the vibration of the composite vibrating body including the vibrating body 3*a*, the piezoelectric element 5, the resin material 7, and the damper 8 can be disturbed more significantly. The sound pressure frequency characteristics therefore can be flattened more, and further improvement in sound quality can be achieved. The similar effects can be achieved also by reducing the width as described later, rather than reducing the thickness of the upper frame member 21.

As illustrated in FIG. 1B, the thinner upper frame member 21 is formed to be thicker than the piezoelectric element 5. The resin material 7 that integrates the vibrating plate 3 (vibrating body 3*a*) and the piezoelectric element 5 is disposed in the internal space S formed with that surface of the vibrating body 3*a* on which the upper frame member 21 is disposed and the inner peripheral surface of the upper frame member 21.

As described above, the upper frame member 21 is formed to be thicker than the piezoelectric element 5, so that the piezoelectric element 5 as a whole can be embedded in the resin material 7. Hence, external force is unlikely to be exerted on the piezoelectric element 5, thereby preventing breakage of the piezoelectric element 5. When the composite vibrating body vibrates, the vibration causes the frame body 2 to be flexed and the diameter of the frame body 2 to be varied. However, when the upper frame member 21 is thicker than the piezoelectric element 5, stress is unlikely to be transmitted to the frame body 2. That is, the frame body 2 is less flexed, and deterioration of sound quality due to the flexion of the frame body 2 can be suppressed accordingly.

As illustrated in FIG. 1B, the resin material 7 is provided on the entire surface of the inner periphery of the upper frame member 21. Supposing that the inner peripheral surface of the upper frame member 21 is exposed from the resin material 7, the acoustic signal output from the surface of the resin material 7 is reflected by the inner peripheral surface of the upper frame member 21, and the sound quality may be deteriorated. By contrast, when the resin material 7 is provided on the entire surface of the inner periphery of the upper frame member 21 as in the present embodiment, the acoustic signal is unlikely to be reflected by the inner peripheral surface of the upper frame member 21, thereby preventing deterioration of sound quality.

FIG. 1B illustrates an example in which the internal space S formed with the upper frame member 21 and the vibrating body 3*a* is filled with the resin material 7. However, as long as the resin material 7 is provided at least on the entire surface of the inner periphery of the upper frame member 21, it is not necessarily required that the internal space S be filled with the resin material 7. This embodiment will be described later.

In the acoustic generator 1 according to the present embodiment, the damper 8 is mounted on that surface of the vibrating body 3*a* on which the thicker lower frame member 22 of the two frame members 21 and 22 is disposed.

The thicker lower frame member 22 of the two frame members 21 and 22 is less deformable by stress, that is, has a higher damper effect. Resonance can be effectively suppressed by providing the damper 8 on that surface of the vibrating body 3*a* on which such a lower frame member 22 is disposed, because of the synergistic effect of the lower frame member 22 and the damper 8. The similar effects can be achieved also by increasing the width as described later, rather than increasing the thickness of the lower frame member 22.

Although FIG. 1B illustrates an example in which the acoustic generator 1 has two dampers 8, the number of dampers 8 included in the acoustic generator 1 may be one or three or more. The acoustic generator 1 is not necessarily required to include a damper 8.

A variety of modifications of the acoustic generator 1 according to the present embodiment will now be described with reference to FIG. 2A to FIG. 2F. FIG. 2A to FIG. 2F are schematic cross sectional views each illustrating a modification of the acoustic generator 1. In FIG. 2A to FIG. 2F, the internal structure of the piezoelectric element 5 is omitted and illustrated in blank in order to facilitate understanding.

In the acoustic generator 1 according to the present embodiment, the resin material 7 is provided only on the inner peripheral surface of the upper frame member 21. However, the resin material 7 may be additionally provided on at least part of a surface other than the inner periphery of the frame body 2.

Figure 2A:
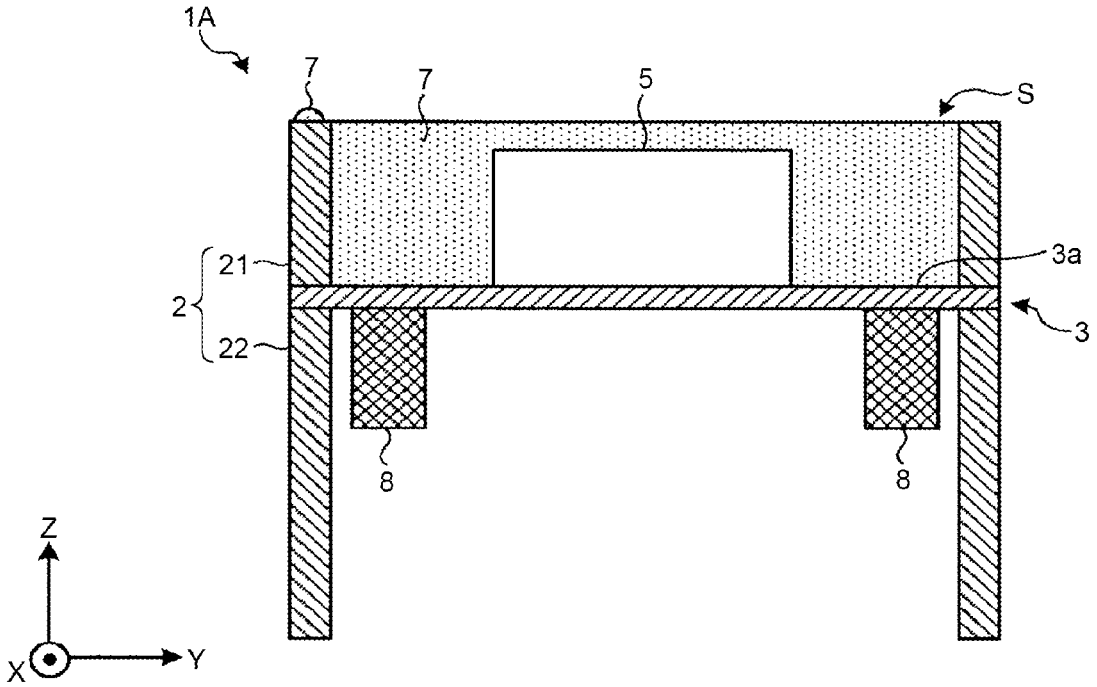
FIG. 2A is a schematic cross sectional view illustrating a first modification of the acoustic generator.
Figure 2B:
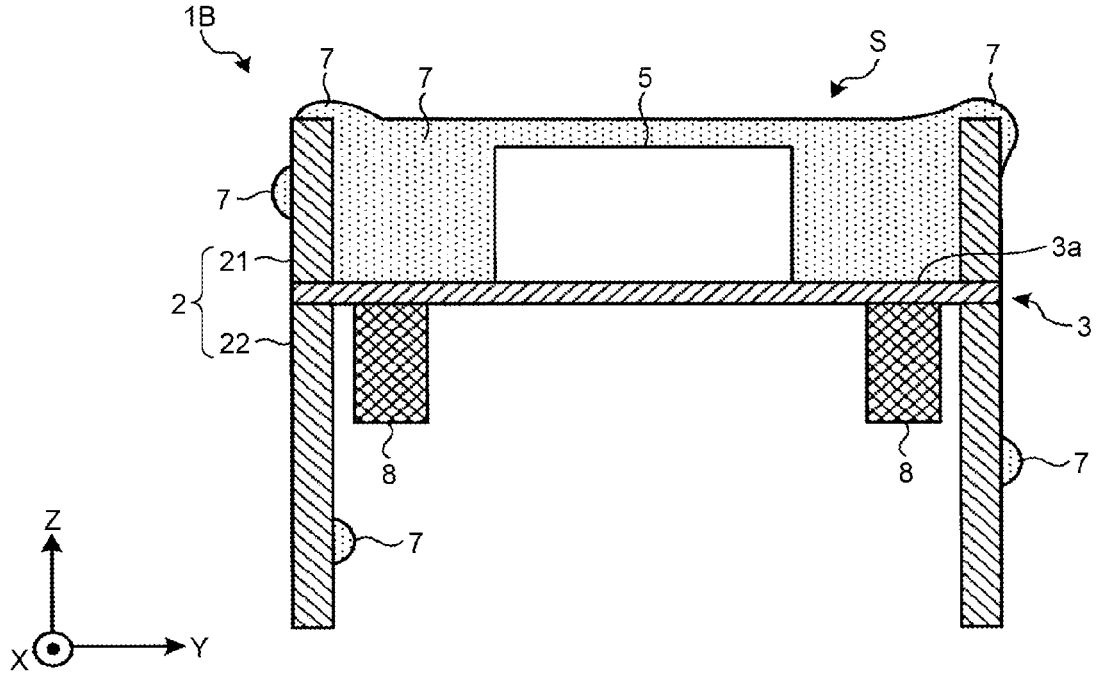
FIG. 2B is a schematic cross sectional view illustrating a second modification of the acoustic generator.

For example, as illustrated in FIG. 2A, in an acoustic generator 1A according to a first modification, the resin material 7 is also provided on part of the edge surface of the upper frame member 21.

As described above, when the resin material 7 having a Young's modulus different from that of the upper frame member 21 is provided on a surface other than the inner periphery of the upper frame member 21, the oscillatory wave of the upper frame member 21 is disturbed, so that the vibration of the composite vibrating body including the vibrating body 3*a*, the piezoelectric element 5, the resin material 7, and the damper 8 can be disturbed more. The sound pressure frequency characteristics therefore can be flattened more, and further improvement in sound quality can be achieved.

The position where the resin material 7 is provided is not limited to the example illustrated in FIG. 2A. For example, as in an acoustic generator 1B according to a second modification illustrated in FIG. 2B, the resin material 7 may be provided on at least part of the outer peripheral surface of the upper frame member 21 or may be provided on at least part of the inner peripheral surface or the outer peripheral surface of the lower frame member 22. The resin material 7 may be provided to extend across the edge surface from the inner peripheral surface of the upper frame member 21 or may be provided to extend across the inner peripheral surface, the edge surface, and the outer peripheral surface of the upper frame member 21.

In the acoustic generator 1 according to the present embodiment, the internal space S formed with the upper frame member 21 and the vibrating body 3*a* is filled with the resin material 7, by way of example. However, the resin material 7 is provided at least on the entire surface of the inner periphery of the upper frame member 21.

Figure 2C:
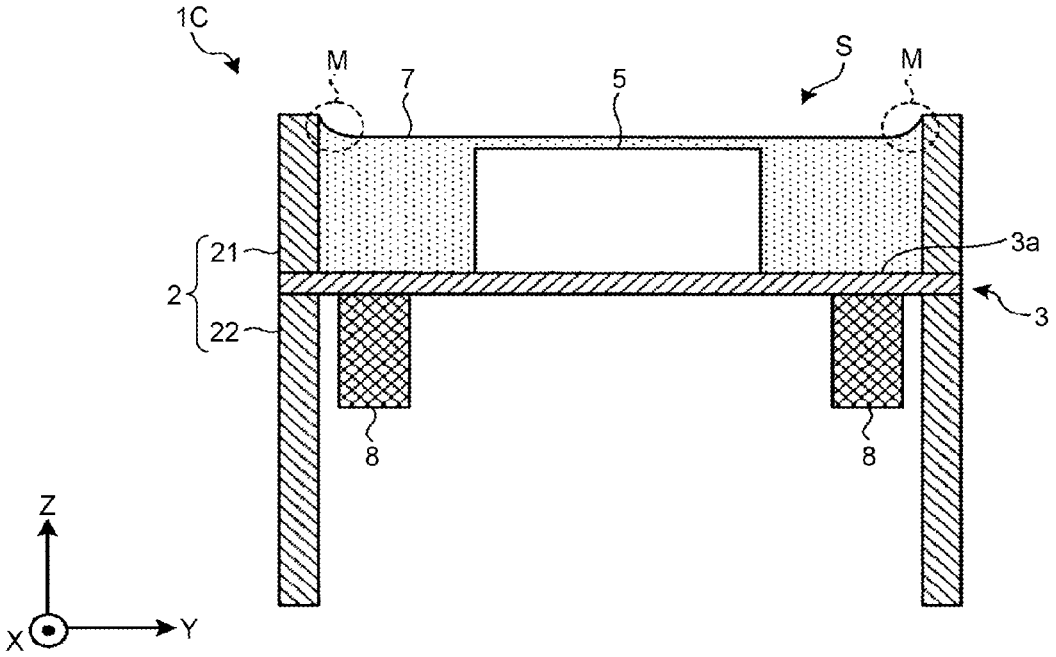
FIG. 2C is a schematic cross sectional view illustrating a third modification of the acoustic generator.

For example, as illustrated in FIG. 2C, in an acoustic generator 1C according to a third modification, a meniscus M is formed on the surface of the resin material 7 along the inner peripheral surface of the upper frame member 21, such that the resin material 7 is provided on the entire surface of the inner periphery of the upper frame member 21.

As described above, when the resin material 7 is provided on the entire surface of the inner periphery of the upper frame member 21 using the meniscus M, deterioration of sound quality due to reflection of the acoustic signal output from the surface of the resin material 7 by the inner peripheral surface of the upper frame member 21 can be prevented while reducing the amount of the resin material 7 used.

In the acoustic generator 1 according to the present embodiment, a frame member having a uniform thickness is used for each of the upper frame member 21 and the lower frame member 22. However, an upper frame member and/or a lower frame member having a non-uniform thickness may be used.

Figure 2D:
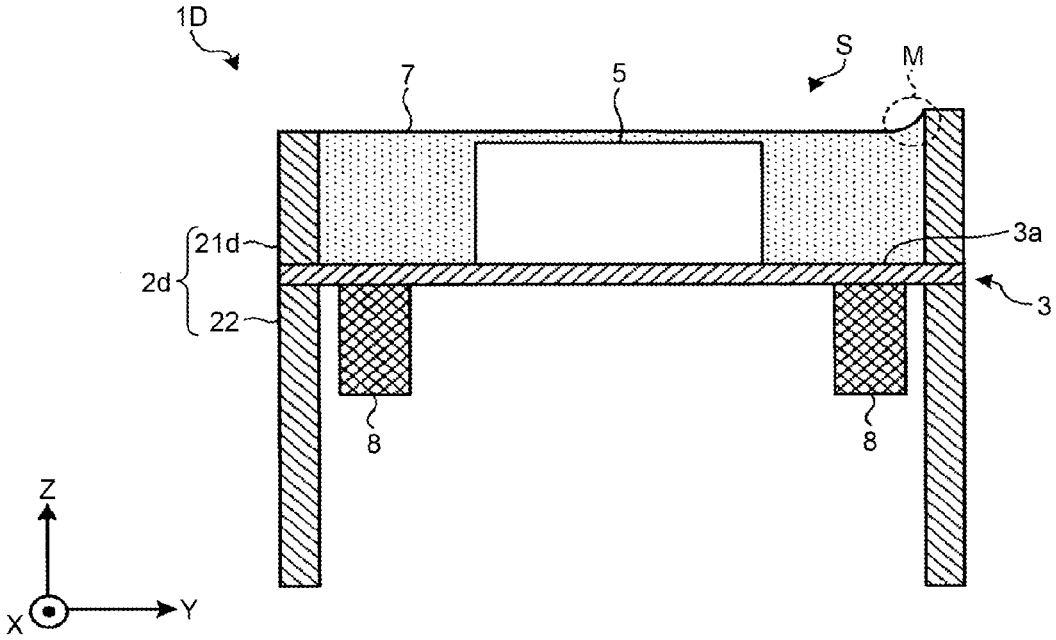
FIG. 2D is a schematic cross sectional view illustrating a fourth modification of the acoustic generator.

For example, as illustrated in FIG. 2D, an acoustic generator ID according to a fourth modification includes a frame body 2*d* in place of the frame body 2 included in the acoustic generator 1 according to the present embodiment. The frame body 2*d* includes an upper frame member 21*d* having a non-uniform thickness and a lower frame member 22 having a uniform thickness.

As described above, when the thickness of the upper frame member 21*d* is not uniform, the resonance frequency of the upper frame member 21*d* can be partially varied per se. Thus, the vibration of the composite vibrating body including the vibrating body 3*a*, the piezoelectric element 5, the resin material 7, and the damper 8 is disturbed more significantly, so that the sound pressure frequency characteristics are flattened more, thereby further improving the sound quality.

As illustrated in FIG. 2D, the non-uniformity of the thickness of the upper frame member 21*d* is preferably to such a degree that the meniscus M is formed on the inner peripheral surface at the thickest portion of the upper frame member 21*d* in a state in which the upper frame member 21*d* is filled with the resin material 7 up to the edge surface of the thinnest portion. The resin material 7 therefore can be easily provided on the entire surface of the inner periphery of the upper frame member 21*d*. Although an example in which the upper frame member 21*d* alone has a non-uniform thickness is illustrated here, the lower frame member 22 also may have a non-uniform thickness.

In the foregoing embodiment and modifications, of the two frame members, the upper frame member has a smaller thickness and the lower frame member has a larger thickness, by way of example. However, conversely, the upper frame member may have a larger thickness and the lower frame member may have a smaller thickness.

Figure 2E:
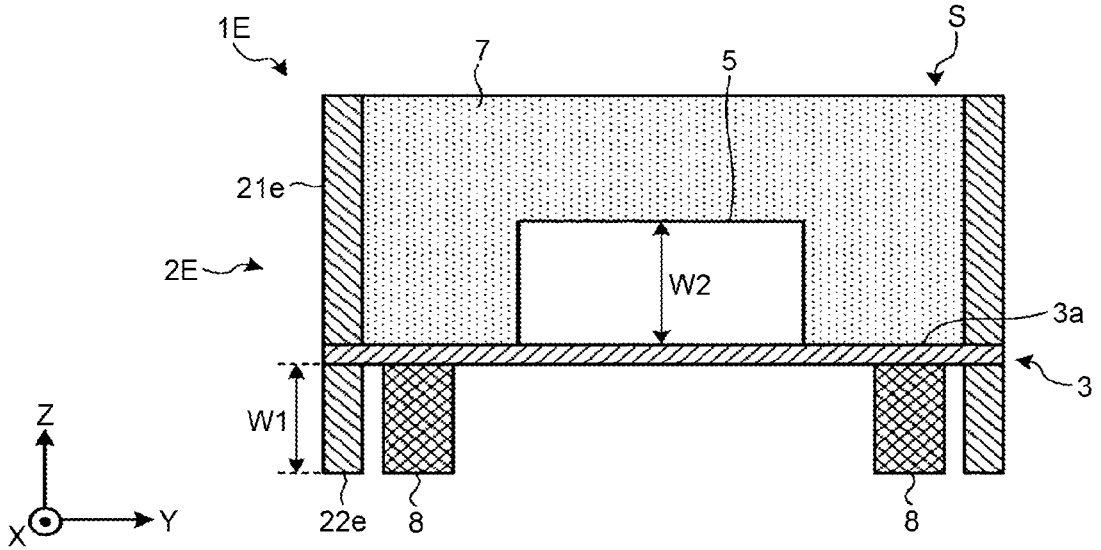
FIG. 2E is a schematic cross sectional view illustrating a fifth modification of the acoustic generator.

For example, as illustrated in FIG. 2E, a frame body 2E in an acoustic generator 1E according to a fifth modification has an upper frame member 21*e* and a lower frame member 22*e* thinner than the upper frame member 21*e*.

In such the acoustic generator 1E, unlike the foregoing embodiment and modifications, the piezoelectric element 5 is mounted on that surface of the vibrating body 3*a* on which the thicker upper frame member 21*e* is disposed, and the damper 8 is mounted on that surface of the vibrating plate 3 (vibrating body 3*a*) on which the thinner lower frame member 22*e* is disposed. As described above, the piezoelectric element 5 may be provided on the thicker frame member and the damper 8 may be provided on the thinner frame member.

In this case, because the thinner frame member vibrates more easily, the output sound pressure from the acoustic generator is greater from the surface of the thinner frame member. The sound signal is then output from the thinner frame member, so that excellent sound with fewer peaks/dips can be output while obtaining the output sound pressure.

In the foregoing embodiment and modifications, both of the upper frame member and the lower frame member are formed to be thicker than the piezoelectric element 5, by way of example. However, as in the acoustic generator 1E illustrated in FIG. 2E, of the two frame members 21*e* and 22*e*, the frame member (here, the lower frame member 22*e*) provided on the side on which the piezoelectric element 5 is not disposed may be formed to be thinner than the piezoelectric element 5. As illustrated in FIG. 2E, the thickness of the lower frame member 22*e* is W1, which is thinner than the thickness W2 of the piezoelectric element 5. Because the thinner frame member (lower frame member 22*e*) vibrates more easily, if the lower frame member 22*e* is formed to be thinner than the piezoelectric element 5 driven to be deformed, the amplitude of the vibrating plate 3 can be larger than the thickness of the lower frame member 22*e*. As a result, the sound signal is output further toward the outer periphery of the lower frame member 22*e*. Therefore, while the output sound pressure is obtained by allowing the sound signal to be output from the thinner, lower frame member 22*e*, excellent and realistic sound effects without directivity can be achieved with excellent sound with fewer peaks/dips.

Figure 2F:
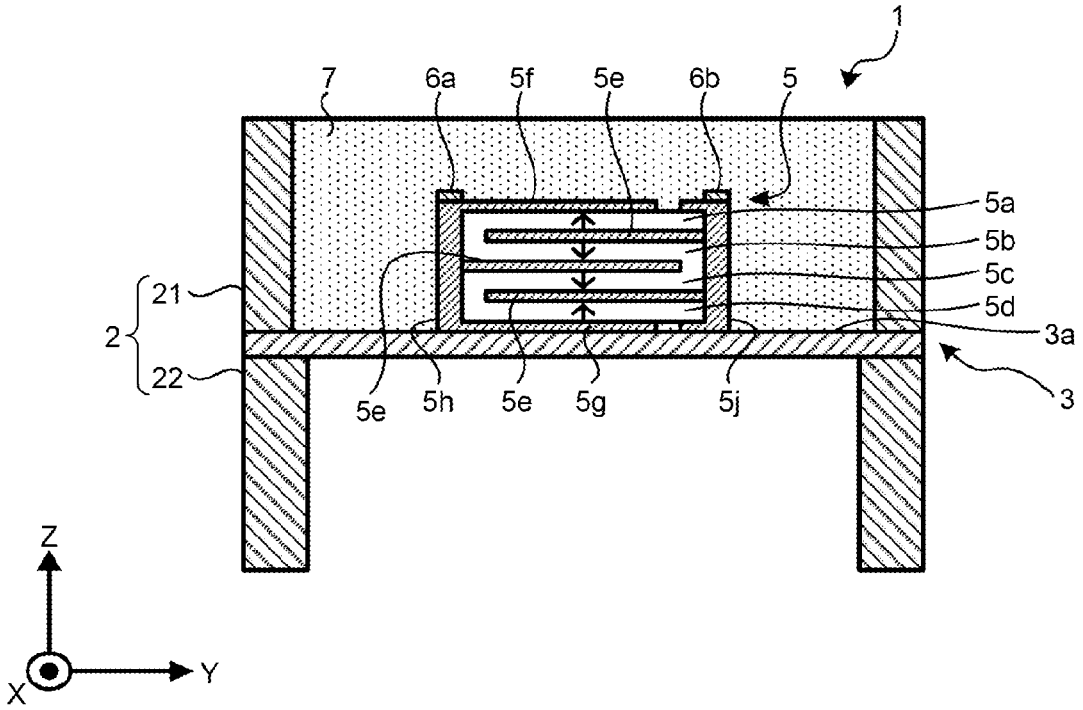
FIG. 2F is a schematic cross sectional view illustrating a sixth modification of the acoustic generator.

As another modification, as illustrated in FIG. 2F, the upper frame member 21 and the lower frame member 22 may be made of the same material, and the width of the upper frame member 21 may be different from the width of the lower frame member 22. Even in such a configuration, the vibration of the composite vibrating body including the vibrating body 3*a*, the piezoelectric element 5, the resin material 7, and the damper 8 that integrally vibrate is disturbed at different frequencies by the reflected waves from the upper frame member 21 and the lower frame member 22, so that the difference between resonance peaks and dips in sound pressure frequency characteristics can be suppressed and the frequency characteristics can be flattened. The flattened sound pressure can improve sound quality.

When the upper frame member 21 and the lower frame member 22 have different widths, although the effects can be achieved as long as the widths are different, it is more effective when the width of the wider frame member is set, for example, 1.2 to 5 times larger than the width of the narrower frame member.

The acoustic generator 1 illustrated in FIG. 2F does not include a damper 8. The acoustic generator 1 in the present example is not necessarily required to include a damper 8.

As yet another modification, the width of the upper frame member 21 and the material of the lower frame member 22 may be different. For example, examples of the combination of materials of the upper frame member 21 and the lower frame member 22 include metal and glass, metal and plastic, glass and plastic, and metals including aluminum and stainless steel. Even with such a configuration, the vibration of the composite vibrating body including the vibrating body 3*a*, the piezoelectric element 5, the resin material 7, and the damper 8 that integrally vibrate is disturbed at different frequencies by the reflected waves from the upper frame member 21 and the lower frame member 22, so that the difference between resonance peaks and dips in sound pressure frequency characteristics can be suppressed and the frequency characteristics can be flattened. The flattened sound pressure can improve sound quality.

Figure 3A:
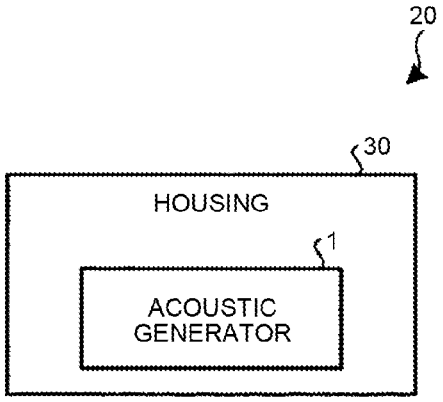
FIG. 3A is a diagram illustrating a configuration of an acoustic generation device according to an embodiment.
Figure 3B:
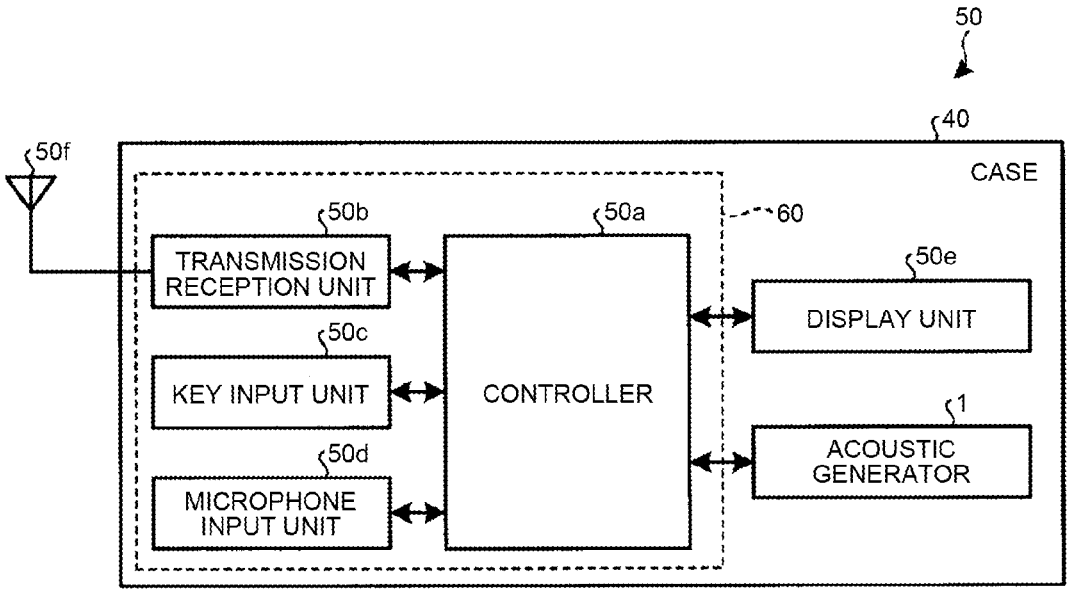
FIG. 3B is a diagram illustrating a configuration of an electronic device according to an embodiment.

An acoustic generation device and an electronic device equipped with the acoustic generator 1 according to the embodiment described above will now be described with reference to FIG. 3A and FIG. 3B. FIG. 3A is a diagram illustrating a configuration of an acoustic generation device 20 according to an embodiment, and FIG. 3B is a diagram illustrating a configuration of an electronic device 50 according to an embodiment. These diagrams illustrate only the components required for description and do not illustrate general components.

The acoustic generation device 20 is a sound generating device such as a speaker and includes, for example, the acoustic generator 1 and a housing 30 for accommodating the acoustic generator 1, as illustrated in FIG. 3A. The housing 30 resonates sound produced by the acoustic generator 1 in the inside and emits the sound from a not-illustrated opening defined in the housing 30 to the outside. The provision of this housing 30 can enhance the sound pressure, for example, in a low frequency band.

The acoustic generator 1 may be installed in different types of electronic devices 50. For example, in FIG. 3B described below, the electronic device 50 is explained to be a mobile electronic device, such as a mobile phone or a tablet terminal.

As illustrated in FIG. 3B, the electronic device 50 includes an electronic circuit 60. The electronic circuit 60 includes, for example, a controller 50*a*, a transmission reception unit 50*b*, a key input unit 50*c*, and a microphone input unit 50*d*. The electronic circuit 60 is connected to the acoustic generator 1, and serves to output an audio signal to the acoustic generator 1. The acoustic generator 1 generates sound based on the audio signal received from the electronic circuit 60.

The electronic device 50 also includes a display unit 50*e*, an antenna 50*f*, and the acoustic generator 1. The electronic device 50 also includes a case 40 in which these devices are housed.

Although FIG. 3B represents a state in which all of the devices including the controller 50*a* are accommodated in a single case 40, the manner in which the devices are accommodated is not limited to this example. In the present embodiment, at least the electronic circuit 60 and the acoustic generator 1 are accommodated in a single case 40.

The controller 50*a* is a control unit for the electronic device 50. The transmission reception unit 50*b* exchanges data, for example, via the antenna 50*f*, based on the control of the controller 50*a*.

The key input unit 50*c* is an input device for the electronic device 50, and receives operations of key inputs performed by an operator. The microphone input unit 50*d* is also an input device for the electronic device 50, and receives operations of voice inputs of an operator.

The display unit 50*e* is a display output device for the electronic device 50, and outputs information to be displayed based on the control of the controller 50*a*.

The acoustic generator 1 operates as a sound output device in the electronic device 50. The acoustic generator 1 is connected to the controller 50*a* in the electronic circuit 60, and receives an application of a voltage controlled by the controller 50*a* and outputs sound.

Explained with reference to FIG. 3B is an example in which the electronic device 50 is a mobile electronic device, but the type of the electronic device 50 is not limited thereto, and may be used in various types of consumer devices having a function of generating sound. The electronic device 50 may be a flat television or a car audio system, for example, and may be used in various types of products with a function outputting sound, such as those with a function of "speaking", examples of which include a vacuum cleaner, a washing machine, a refrigerator, and a microwave oven.

Mainly explained in the embodiment described above is an example in which the piezoelectric element is provided on one principal surface of the vibrating body, but the configuration is not limited thereto, and the piezoelectric element may be provided on both surfaces of the vibrating body.

Furthermore, explained in the embodiment described above is an example in which the exciter is the piezoelectric element 5, but the exciter is not limited to a piezoelectric element, and may be any exciter having a function of receiving an electrical signal and causing vibration. The exciter may be, for example, an electrodynamic exciter, an electrostatic exciter, or an electromagnetic exciter that are known exciters causing a speaker to vibrate. The electrodynamic exciter applies a current to a coil positioned between magnetic poles of permanent magnets, and causes the coil to vibrate. The electrostatic exciter applies a bias and an electrical signal to two metal plates facing each other, and causes the metal plates to vibrate. The electromagnetic exciter supplies an electrical signal to a coil, and causes a thin steel sheet to vibrate.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The invention claimed is:

1. An acoustic generator at least comprising:

an exciter that is caused to vibrate by an electrical signal;

a vibrating plate on which the exciter is mounted and that is caused to vibrate together with the exciter by the vibration of the exciter; and a frame body that is provided on an outer peripheral portion of the vibrating plate, wherein the frame body includes two frame members having different thicknesses or widths, and the two frame members nip the outer peripheral portion of the vibrating plate to support the vibrating plate, wherein of the two frame members, one frame member on which the exciter is disposed has a thickness larger than a thickness of the exciter, and a resin material that integrates the vibrating plate and the exciter is provided in a space formed with an inner peripheral surface of the one frame member and a surface of the vibrating plate, and the resin material is provided on an entire surface of the inner peripheral surface of the one frame member.

2. The acoustic generator according to claim 1, wherein the exciter is mounted on a surface of the vibrating plate on which a thinner frame member or a narrower frame member of the two frame members is disposed.

3. The acoustic generator according to claim 2, further comprising a damper integrated with the vibrating plate and the exciter, wherein the damper is mounted on a surface of the vibrating plate on which a thicker frame member or a wider frame member of the two frame members is disposed.

4. The acoustic generator according to claim 1, wherein the exciter is mounted on a surface of the vibrating plate on which a thicker frame member or a wider frame member of the two frame members is disposed.

5. The acoustic generator according to claim 4, wherein a thinner frame member of the two frame members has a thickness smaller than a thickness of the exciter.

6. The acoustic generator according to claim 4, further comprising a damper integrated with the vibrating plate and the exciter, wherein the damper is mounted on a surface of the vibrating plate on which a thinner frame member or a narrower frame member of the two frame members is disposed.

7. The acoustic generator according to claim 1, wherein the exciter is a piezoelectric element.

8. The acoustic generator according to claim 1, wherein the vibrating plate is made of a resin film.

9. An acoustic generation device comprising:

the acoustic generator according to claim 1; and a housing that accommodates the acoustic generator.

10. An electronic device comprising:

the acoustic generator according to claim 1;

an electronic circuit that is connected to the acoustic generator; and a case that accommodates the electronic circuit and the acoustic generator, wherein the electronic device has a function of producing sound from the acoustic generator.

* * * * *